US009009879B2

(12) United States Patent
Amendt

(10) Patent No.: US 9,009,879 B2
(45) Date of Patent: Apr. 21, 2015

(54) AIR MANAGEMENT SYSTEM FOR A SPA

(75) Inventor: Darcy S Amendt, Breton (CA)

(73) Assignee: SPA Logic, Inc., Calgary (CA)

( * ) Notice: Subject to any disclaimer, the term of this patent is extended or adjusted under 35 U.S.C. 154(b) by 632 days.

(21) Appl. No.: 13/422,224

(22) Filed: Mar. 16, 2012

(65) Prior Publication Data

US 2012/0240325 A1 Sep. 27, 2012

Related U.S. Application Data

(60) Provisional application No. 61/466,515, filed on Mar. 23, 2011.

(51) Int. Cl.
*A47K 3/02* (2006.01)
*A61H 33/00* (2006.01)

(52) U.S. Cl.
CPC .... *A61H 33/6005* (2013.01); *A61H 2201/5082* (2013.01)

(58) Field of Classification Search
CPC ..... A47K 3/02
USPC ..... 4/538–595
See application file for complete search history.

(56) References Cited

U.S. PATENT DOCUMENTS 7,699,051 B2 * 4/2010 Gagas et al. ..... 126/299 D

* cited by examiner

*Primary Examiner* — Lori Baker
(74) *Attorney, Agent, or Firm* — Goodwin Law; Sean W Goodwin

(57) ABSTRACT

An air management system for an insulated spa cabinet is provided. The air management system monitors the temperature of an equipment air space in the cabinet and vents overheated air in a controlled manner from the cabinet. The air management system comprises an air passageway, formed by a U-trap, between an inlet in the air space and an exterior of the cabinet. The system also comprises an air mover and a sensor. The sensor monitors the temperature in the air space and when the temperature is above a set temperature threshold, the air mover is operated to direct air from the air space through the passageway from the inlet to the discharge for controlled venting of overheated air.

9 Claims, 3 Drawing Sheets

AIR MANAGEMENT SYSTEM FOR A SPA

CROSS REFERENCE TO RELATED APPLICATION

This application is a regular application claiming priority of U.S. Provisional Patent application Ser. No. 61/466,515 filed on Mar. 23, 2011, the entirety of which is incorporated herein by reference.

FIELD

Embodiments described herein relate to an air management system for a spa. More particularly, the embodiments relate to temperature control of an air space between a spa vessel and an insulated spa cabinet.

BACKGROUND

Spas, such as portable spas, typically accommodate four to twelve individuals and are usually stand-alone upright structures in which a water reservoir, plumbing and controls are housed within a cabinet for forming a single self-contained unit. Portable spas are popular as they can be located at virtually every home. Spas are typically installed outdoors and can be used all year round, including in winter freezing conditions and at elevated summer temperatures. Particularly for use at sub-zero conditions, water in the water reservoir or spa vessel is typically maintained at a temperature slightly above body temperature (such as about 103° F.). To date, the water in the spa vessel is typically heated by flowing the water through a heating device, such as being pumped through a compressor-based flow-through heat pump or by directly contacting the water with a submersed resistive heating element. A removable insulated spa cover, positioned to cover the temperature controlled water, minimizes heat losses from the water during periods of low ambient temperature and non-use.

Applicant has, for some time, utilized an insulated cabinet for supporting the spa vessel therein. The insulated cabinet retains heat in an air space formed about the spa vessel between the insulated cabinet and the spa vessel. Motors, heaters, controllers and other plumbing equipment are typically located in this air space. In cooler seasons, significant energy savings are achieved by retaining the heat in the warm air space between the spa vessel and the insulated cabinet. Unfortunately, as the outside environment becomes warmer, the air space can become too hot for the spa equipment or components resident therein.

To date, hot air from the air space has been passively managed through inherent heat loss from the cabinet and imperfect sealing of the air space. One convenient break in the otherwise sealed, insulated cabinet has been the removable access panels provided in the cabinet. The access panels have not been tightly sealed to the cabinet and permit some infiltration and ex-filtration of ambient air. This crude methodology has resulted in sufficient heat loss to protect components during hot seasons, but has also resulted in unmanaged and reduced efficiency during cooler seasons.

There is interest in apparatus and methods for cooling the air space in a controlled manner without compromising efficiency and without risk to the components resident in the air space.

SUMMARY

Embodiments described herein are directed to an air management system for an insulated cabinet of a spa. The air management system enables the spa to retain a maximal amount of heat in an air space between a spa vessel and the insulated spa cabinet supporting the spa vessel while managing the build up of excess heat therein. The temperature of the air space is monitored and overheated air controllably vented from the spa. In an aspect, the air management system provides one or more air traps which discourages convective air flow from the air space in favor of a controlled air movement for overcoming the air trap and venting overheated air from the air space.

Accordingly in one broad aspect an air management system for an insulated spa cabinet is provided. The cabinet comprises a water containment vessel fit thereto for forming a contained air space therebetween. The air management system comprises an air passageway extending between an inlet in the air space and a discharge to an exterior of the cabinet. The passageway comprises a U-trap having a first plenum extending downwardly from the discharge to a sump, and a second plenum extending upwardly from the sump to the inlet at an upper portion of the air space. The air management system further comprises an air mover and a sensor. The air mover is located between the air space and the exterior of the cabinet. The sensor is connected to the air space for detecting air temperature in the air space. During operation of the spa, normally air is trapped in the passageway and in the air space and when the air temperature is above a set temperature threshold the air mover is operated to direct air from the air space through the passageway from the inlet to the discharge.

Accordingly in another broad aspect a spa is provided. The spa comprises an insulated spa cabinet and a water containment vessel fit to the cabinet for forming a contained air space between the vessel and the cabinet. The spa further comprises an air management system disposed in the air space. The air management comprises an air passageway extending between an inlet in the air space and a discharge to an exterior of the cabinet. The passageway comprises a U-trap having a first plenum extending downwardly from the discharge to a sump, and a second plenum extending upwardly from the sump to the inlet at an upper portion of the air space. The air management system further comprises an air mover and a sensor. The air mover is located between the air space and the exterior of the cabinet. The sensor is connected to the air space for detecting air temperature in the air space. During operation of the spa, normally air is trapped in the passageway and in the air space and when the air temperature is above a set temperature threshold the air mover is operated to direct air from the air space through the passageway from the inlet to the discharge.

Accordingly in another broad aspect an air management system for an insulated spa cabinet is provided. The cabinet comprises a water containment vessel fit thereto for forming a contained air space therebetween. The air management system is located in the air space and comprises a first plenum having an outlet at an upper end thereof. The outlet is connected with an exterior of the cabinet. The system further comprises a second plenum having an inlet at an upper end of the air space. The inlet is connected to the air space. The first and second plenums are operatively connected at respective lower ends to form a U-trap. The system also comprises a temperature sensing means, a controller and an air mover operatively connected to the controller. The temperature sensing means determines temperature of the air in the air space. The controller determines if air in the air space is above or below a set temperature threshold. When the temperature of the air at the temperature sensing means is below the threshold, the air mover is inoperative. When the temperature of the air at the temperature sensing means is above the threshold, the air mover directs air from the air space into the inlet, through the second plenum, through the first plenum and out of the upper outlet for removal of the air from the spa cabinet.

DETAILED DESCRIPTION OF THE PREFERRED EMBODIMENT

Herein, embodiments of the description are directed to an air management system for a spa for controlling air temperature in the equipment air space between an insulated cabinet and a water vessel of the spa.

Figure 1:
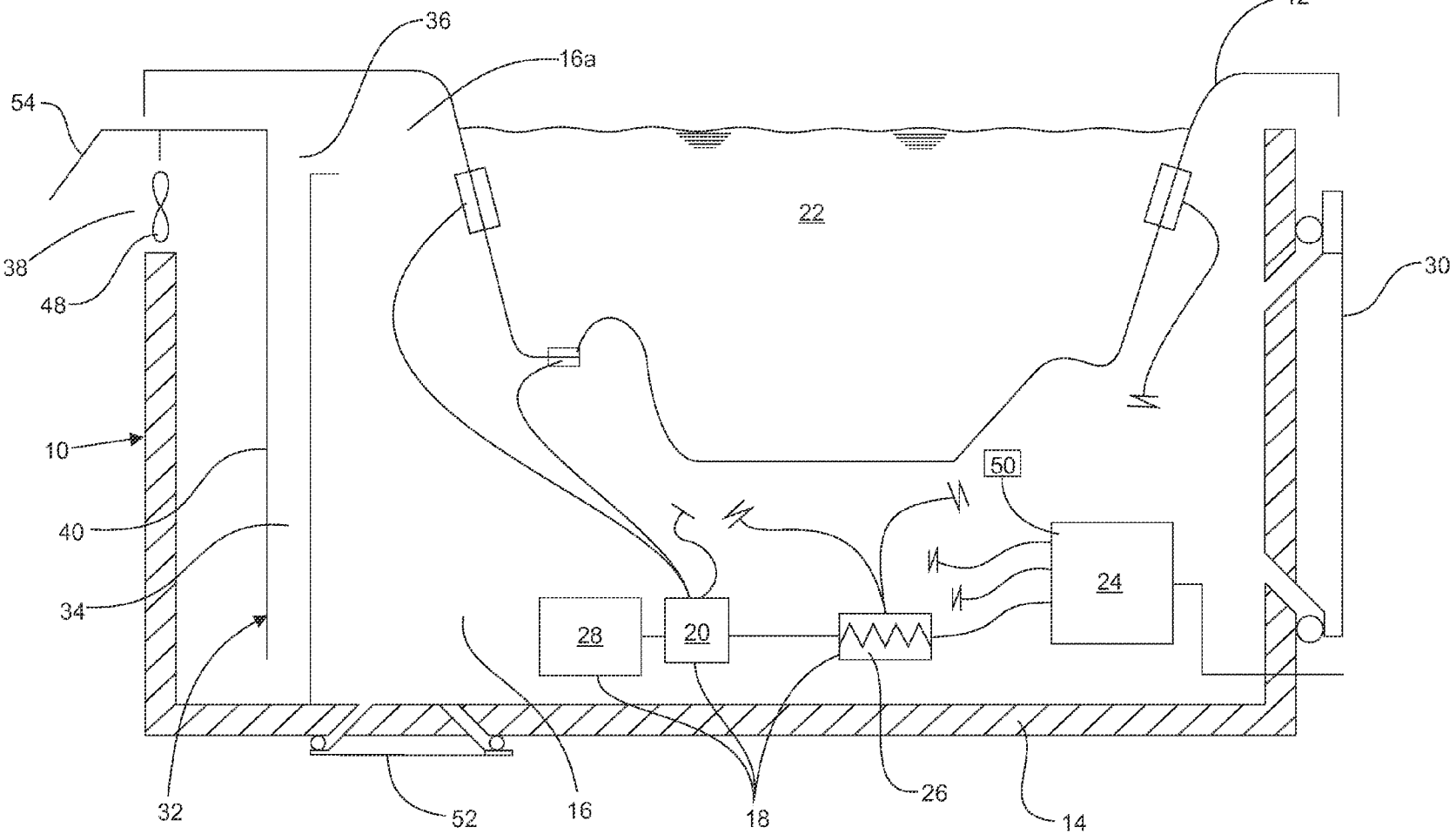
FIG. 1 is a schematic drawing of a spa having an insulated spa cabinet and fit with an air management system according to one embodiment.

With reference to FIG. 1, one embodiment of a spa 10 comprises a water containment vessel 12 which is supported in an insulated spa cabinet or enclosure 14. An air space 16 is formed between the spa cabinet 14 and the water containment vessel 12. Conventional spa equipment 18 are housed within the air space 16, such equipment 18 including pumps and piping 20 for supply, recirculation and draining of the water 22 in the vessel 12 and other equipment such as spa controller 24, heaters 26 and motors 28. Typically the spa controller controls the spa equipment such as the pumps ad piping 20, heaters 36 and motors 28. The spa cabinet 14 is generally aesthetically pleasing and shields the vessel 12 and associated equipment 18 and the like from the environment. Typically the vessel 12 is formed from a material such as an ABS plastic shell supported by a layer of fibreglass thereunder.

The vessel 12 is sealed at its periphery to the spa cabinet 14. The spa cabinet 14 is typically provided with one or more removable access panels 30 to access the air space 16 for servicing the equipment 18. The access panels 30 are also sealed to the cabinet 14 when fit in place for operation. The term sealed means that at warm ambient temperatures, insufficient passive air exchange or leakage occurs, to and from the air space 16, to avoid overheating of the equipment 18.

The spa 10 is capable of both warm and cold ambient weather operation. The water 22 in the spa vessel 12 is typically directly heated by flowing the water 22 through heaters 26 or, indirectly, by heating the air space 16 surrounding the spa vessel 12. Heating of the water 22 in the vessel 12 results in an increase in temperature in the air space 16. Operation of the equipment 18 such as pumps 20 and motors 28 also result in generation of incidental heat in the air space 16.

During winter, cold weather operation there is typically sufficient heat loss from the spa cabinet 14 to counter overheating of the air space 16, enabling continued efficient performance of the equipment 18 without need for intervention. As the cabinet 14 is insulated, the incidental heat is retained in the air space 16 and may be directed inward towards the vessel 12 for heating the water 22. Capture and indirect transfer of the incidental heat to the water 22 can result in decreased heating costs. Thus a substantially air-tight, energy efficient air space 16 is used for maximal energy savings during much of the operation season.

However, in warm seasons, as the ambient exterior temperature is warm, natural heat loss from the cabinet 14 is insufficient to counteract the heat generated from the water 22 and incidental heat produced by the equipment 18. Further as the access panels 30 are now better sealed to the cabinet 14, a usual source of leakage is lost and the hot air in the air space 16 is not exchanged. The insulated cabinet 14 minimizes heat loss. Accordingly, without cooling, the heat generation and loss imbalance may result in overheating of the air space 16 and premature failure of the equipment 18. While mere vents can result in temperature management in warm seasons, they are also an uncontrolled loss of heat in cold seasons.

Figure 2:
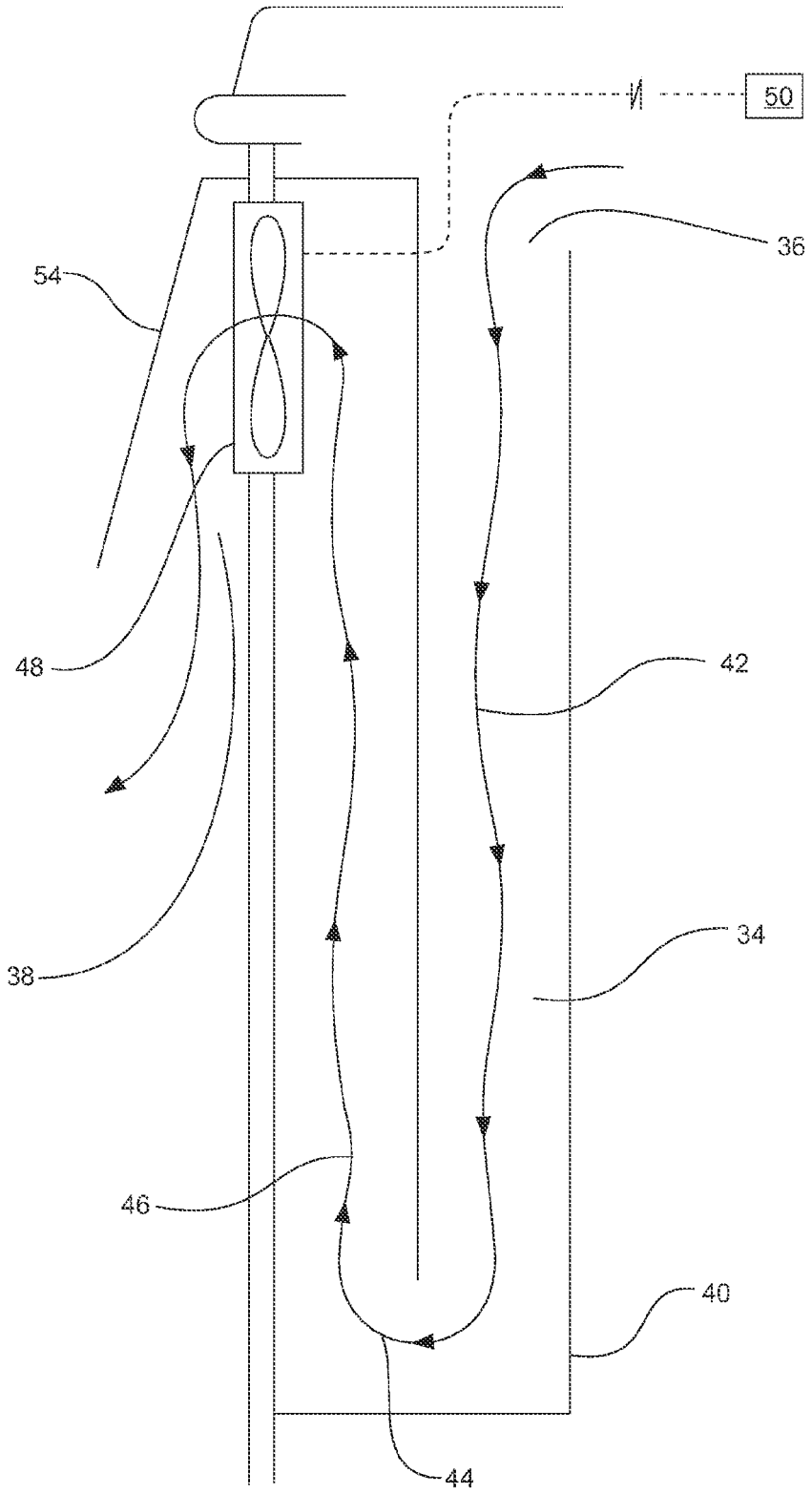
FIG. 2 is an enlarged view of an air trap of the air management system of FIG. 1.

Accordingly, and with reference as well to FIG. 2, the spa 10 further comprises an air management system or an exhaust system 32 for controlled removal of hot air from the air space 16. Typically the air management system 32 is located partially or wholly within the insulated cabinet 14.

The air management system comprises an air passageway 34 extending between an inlet 36 in the air space 16 and an outlet or discharge 38 to an exterior of the cabinet 14. The air passageway 34 is provided with at least one air trap or U-trap 40 for restricting free convective flow of heated air from the inlet 36 to the discharge 38. The U-trap 40 is a form of Hartford Loop applied to convective air systems rather than the typical boiler implementations. The U-trap comprises a first or upflow plenum 42 formed between the discharge 38 and a lower end or sump 44 forming the bottom of the U-trap. The sump 44 is located low in the cabinet 14. A second or downflow plenum 46 is fluidly connected to the first plenum 42 at the sump 44. As the hottest air collects in an upper portion 16*a* of the air space 16, the inlet 36 is located at about the upper portion 16*a*. Cooler air pools in the sump 44, interrupting natural convective flow of hot air up the upflow plenum 42.

The air management system further comprises a forced air means or air mover 48, such as a fan. The air mover 48 provides impetus to overcome the otherwise trapped or stagnant air condition in the U-trap 40 and passageway 34. The air mover 48 can be located anywhere between the air space and the exterior environment. In an embodiment, the air mover 48 can be conveniently fit to the passageway 34. Typically the air mover 48 is placed somewhere in the first or second plenum 42, 46 for moving air from the inlet 36 to the discharge 38 when desired, such as when the air space 16 is too hot. In one embodiment, as shown in FIG. 2, the air mover 48 is placed in the first plenum 42 about the discharge 38. Optionally, an air mover 48' can be located in the wall of the cabinet 14 shown as FIG. 3.

The air management system 22 further comprises a temperature sensor or temperature sensing means 50 operatively coupled to the air space 16 for determining the temperature in the air space 16. The sensor 50 is operatively connected to the air mover 48 through a controller. In one embodiment, the temperature sensor 50 may include or act as a temperature controller for monitoring and determining whether the air temperature in the air space 16 is above a predetermined, set temperature threshold and for operating the air mover 48. In another embodiment, the temperature sensor 50 may be connected to a separate controller for operating the air mover 48.

In another embodiment, as shown in FIG. 1, the temperature sensor 50 is operatively coupled to or integrated with the spa controller 24 for operating the air mover 48.

During operation of the spa 10, normally air is trapped in the air passageway 34 and in the air space 16. The air temperature in the air space 16 is monitored by the temperature sensor 50. When the air temperature measured at the temperature sensor 50 exceeds the predetermined, set temperature threshold, the spa controller 24 activates or operates the air mover 48. Hot air from upper portion 16*a* of the air space 16 is drawn or directed into the inlet 36. The hot air moves along the air passageway 34, down the second plenum 46, through the sump 44, up the first plenum 42 and out of the discharge 38 for removal of the air from the sp cabinet 14. The hot air is discharged through the discharge 38 until the air temperature in the air space falls below the set threshold, the controller 24 shuts down the air mover 48. When the temperature of the air at the sensor 50 is below the set threshold, the air mover 48 is inoperative. Other than forced infiltration through gaps in the sealed environment, fresh air may be introduced into the air space 16 through a vent 52 (FIG. 1). Operation of the air mover 48 to remove overheated air causes the vent 52 to open to let in replacement fresh air. Pressure differential between the air space 16 and exterior environment during operation of the air mover 48 can cause the vent 52 to automatically open, such as through a hinged flap. In another embodiment, a countercurrent heat exchanger (not shown) could be integrated with the plenums 42, 46 for drawing in fresh air as heated air is discharged from the air space 16.

In one embodiment, as shown in FIG. 2, a shroud 54 can be located outside the discharge 38 for weatherproofing the discharge 38.

Figure 3:
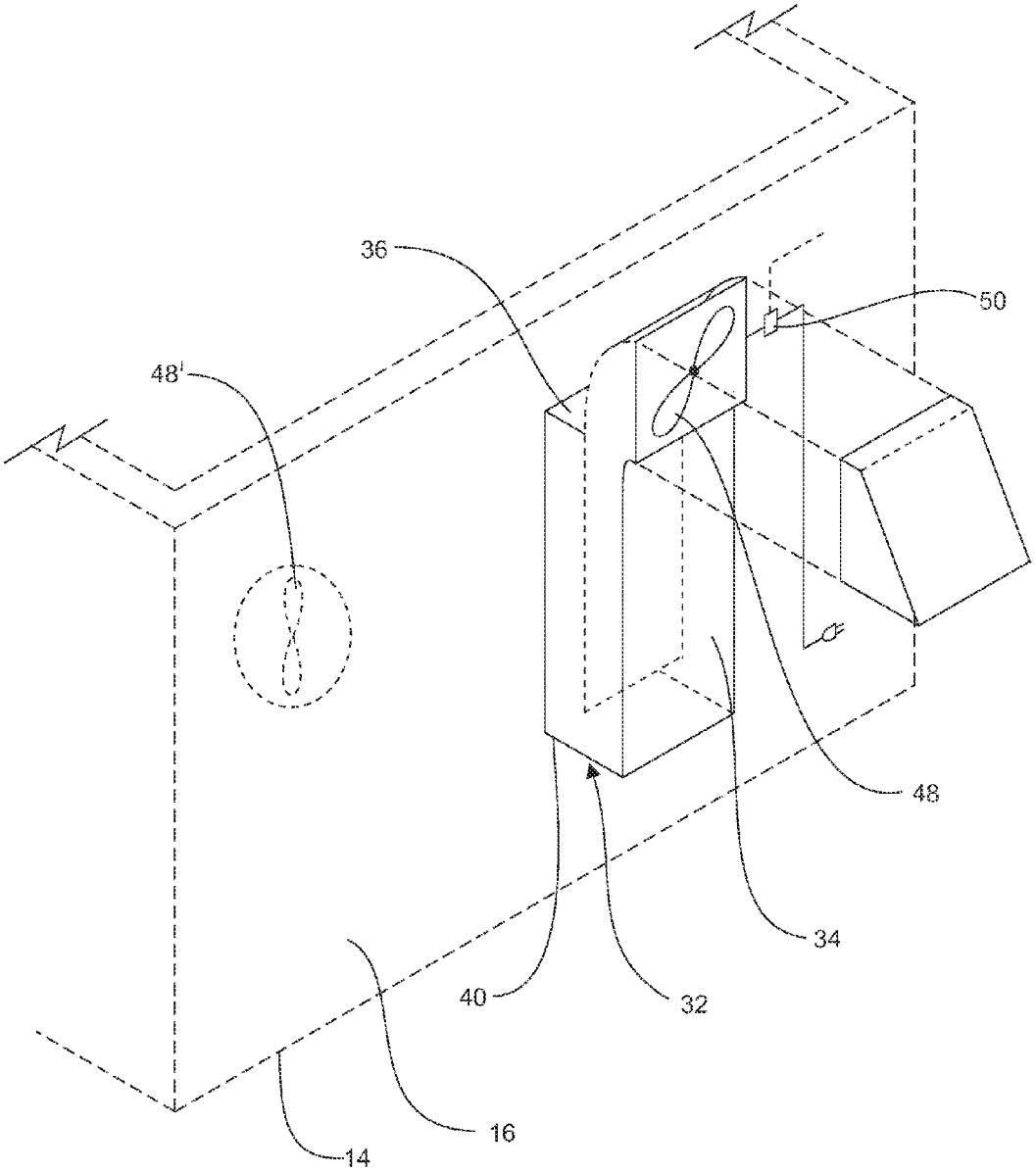
FIG. 3 is a partial perspective view of the air management system of FIG. 1 fit to a spa cabinet (shown in dotted lines).

With reference to FIG. 3, in another embodiment, the air management system 32 can be provided as a retrofit or add-on unit for retrofitting to existing conventional spas otherwise having no managed control of air temperature about the spa equipment. The add-on unit can comprise one or more U-traps 40, an air mover 48 and a temperature controller/sensor 50. The U-trap and air mover might be a packaged unit, more amenable to retrofit in an existing cabinet. Maximum benefit can be achieved by sealing all air infiltration and ex-filtration locations in the existing spa cabinet and interface between the vessel and cabinet.

The embodiments of the invention in which an exclusive property or privilege is claimed are defined as follows:

1. An air management system for an insulated spa cabinet, the cabinet comprising a water containment vessel fit thereto for forming a contained air space therebetween, the air management system comprising:

an air passageway extending between an inlet in the air space and a discharge to an exterior of the cabinet, the passageway comprising a U-trap having a first plenum extending downwardly from the discharge to a sump, and a second plenum extending upwardly from the sump to the inlet at an upper portion of the air space;

an air mover between the air space and the exterior of the cabinet; and a sensor connected to the air space for detecting air temperature in the air space, wherein, normally air is trapped in the passageway and in the air space, and when the air temperature is above a set temperature threshold the air mover is operated to direct air from the air space through the passageway from the inlet to the discharge.

2. The system of claim 1 wherein the air mover is a fan.

3. The system of claim 1 wherein the air mover is a fan located in the passageway about the discharge.

4. The system of claim 1 wherein spa equipment is housed in the air space.

5. The system of claim 4 further comprising a spa controller for controlling the spa equipment.

6. The system of claim 5 wherein the sensor is operatively connected to the spa controller for determining whether the air temperature is above the set temperature threshold and operating the air mover.

7. A spa comprising:

an insulated spa cabinet;

a water containment vessel fit to the cabinet for forming a contained air space between the vessel and the cabinet; and an air management system disposed in the air space, the air management system comprising:

an air passageway extending between an inlet in the air space and a discharge to an exterior of the cabinet, the passageway comprising a U-trap having a first plenum extending downwardly from the discharge to a sump, and a second plenum extending upwardly from the sump to the inlet at an upper portion of the air space;

an air mover between the air space and the exterior of the cabinet; and a sensor connected to the air space for detecting air temperature in the air space, wherein, normally air is trapped in the passageway and in the air space, and when the air temperature is above a set temperature threshold the air mover is operated to direct air from the air space through the passageway from the inlet to the discharge.

8. An air management system for an insulated spa cabinet, the cabinet comprising a water containment vessel fit thereto for forming a contained air space therebetween, the air management system being located in the air space and comprising:

a first plenum having an outlet at an upper end thereof, the outlet being connected with an exterior of the cabinet, a second plenum having an inlet at an upper end thereof, the inlet being connected to the air space, the first and second plenums operatively connected at respective lower ends to form a U-trap;

a temperature sensor for determining temperature of the air in the air space;

a controller for determining if air in the air space is above or below a set temperature threshold;

an air mover operatively connected to the controller, wherein when the temperature of the air at the temperature sensor is below the threshold, the air mover is inoperative, and when the temperature of the air at the temperature sensor is above the threshold, the air mover directs air from the air space into the inlet, through the second plenum, through the first plenum and out of the upper outlet for removal of the air from the spa cabinet.

9. The system of claim 8 wherein the controller is a spa controller.

* * * * *